United States Patent [19]

Krøyer et al.

[11] 3,963,819

[45] June 15, 1976

[54] METHOD OF PREPARING COLORED FIBROUS SHEET MATERIALS

[76] Inventors: Karl Kristian Kobs Krøyer, Vestre Kongevej 80, 8260 Viby J.; Torben Borup Rasmussen, Tousvej 18, 8230 Abyhoj, both of Denmark

[22] Filed: July 20, 1973

[21] Appl. No.: 380,980

Related U.S. Application Data

[63] Continuation of Ser. No. 57,325, July 22, 1970, abandoned.

[52] U.S. Cl. ..... 264/78; 264/121; 264/115; 264/128; 264/246

[51] Int. Cl.[2] ..... D06P 7/00

[58] Field of Search ..... 264/121, 128, 115, 78, 264/246

[56] References Cited

UNITED STATES PATENTS

| | | | |
|---|---|---|---|
| 2,711,381 | 6/1955 | Novotny et al. | 264/121 |
| 2,865,783 | 12/1958 | Henderson et al. | 264/128 |
| 3,050,427 | 8/1962 | Slayter et al. | 264/128 |
| 3,494,263 | 2/1970 | Tachibana et al. | 264/128 |

*Primary Examiner*—Robert F. White
*Assistant Examiner*—J. R. Hall
*Attorney, Agent, or Firm*—Watson, Cole, Grindle & Watson

[57] ABSTRACT

In a method of preparing colored fibrous sheet materials wherein a fiber-pulp is treated in a defibrator to form a stream of gas containing suspended fibers which are caused to form a fibrous layer on a forming surface, a dye or dye solution is added to the fiber-pulp which is introduced into said defibrator.

13 Claims, No Drawings

METHOD OF PREPARING COLORED FIBROUS SHEET MATERIALS

This is a continuation of copending application Ser. No. 57,325, filed July 22, 1970, now abandoned.

BACKGROUND OF THE INVENTION

This invention relates to a method of preparing fibrous sheet materials wherein a fibre-pulp is treated in a defibrator so as to form a stream of gas containing suspended fibres, which stream of gas is caused to pass through a gas-permeable forming surface so as to form a fibrous layer thereon and wherein a binder is supplied to said fibrous layer to bond the fibres together.

It has been attempted to dye fibrous products prepared by methods of the above mentioned type by spraying onto the fibrous layers formed solutions of dyes or by impregnating such layers in a bath containing a dye solution. These methods of dyeing fibrous materials do not result in the formation of uniformly dyed products and when spraying a dye solution onto a fibrous product only the surface layers become dyed. This is unsatisfactory if the fibrous material subsequently is subjected to such influences that portions of the surface layers are abraded.

The object of the present invention is to obtain fibrous materials prepared by a dry process and in which all portions are uniformly dyed.

SUMMARY OF THE INVENTION

The method according to the invention comprises the steps of adding a dye or dye solution to the fibre-pulp which is introduced into the defibrator.

The addition of a dye or dye solution can be effected in various ways but a common feature of all such methods is that the dye will become uniformly distributed in the whole fibrous layer formed on the forming surface after the treatment of the fibre-pulp in the defibrator.

It is especially advantageous to use a dye solution because in this case the dye will become stronger bonded to the fibrous material than in case a dry dye has been admixed with the fibres. It might be expected that the introduction of the liquid in which the dye is dissolved would cause problems during the subsequent treatment of the fibre-pulp in the defibrator. However, surprisingly it has been found that the presence of limited amounts of liquid in the fibre-pulp to be defibrated actually is advantageous because the liquid facilitates the separation of the fibres from one another without breaking said fibres. Furthermore, it has been found that during the treatment of the fibre-pulp in the defibrator sufficient heat is generated so as to evaporate the major part of the liquid introduced. Consequently, the final product does not contain excessive amounts of said liquid. Another preferred method of applying the dye onto a pulp web consists in passing the pulp through a bath containing a dye solution. By such an impregnation the fibre-pulp becomes thoroughly dyed. Another method of applying the dye onto the fibrous product consists in spraying a dye solution onto the pulp web during its movement into the defibrator. The irregularly dyed product which generally is obtained when applying the dye by spraying has no influence on the colour of the final fibrous layer because of the subsequent defibration of the pulp web in the defibrator. The dye solution may also be applied onto the pulp web by passing said web through a set of rollers in which the surface of one of the rollers continuously is moistened with the dye solution. The moistening of the surface of said roller can for example be effected by means of one or more additonal rollers, at least one of said rollers rotating with a portion of the surface immersed into a dye bath.

The dye or dye solution may also be introduced directly into the defibrator and, if desired, together with a filler. By using a dye solution the filler may also be dyed. It is pointed out that in some cases where solid dyes are used, these dyes may be more similar to fillers than actual dyes. However, also such methods fall within the scope of the invention because the uniform and complete dyeing of the fibrous material which is a characteristic feature of the invention will also be obtained in these cases.

By applying two or more dye solutions to various portions of the fibre-pulp, fibrous materials having mixed colours can be obtained.

Such fibrous materials can also be prepared by adding a dye solution to only a portion of the fibre-pulp.

If an aqueous dye solution is used, the total amount of water introduced into a cellulose fibre-pulp should not exceed 30% by weight, and if ethanol is used as a solvent it should not be used in an amount of more than 60%. Thus, if a fibre-pulp containing higher amounts of water or ethanol is introduced into the defibrator, the defibrated fibres tend to be tacky and adhere to one another as well as to the walls and moving parts of the defibrator.

A particularly suitable product is formed when the fibre-pulp to be defibrated contains about 20% by weight of water and 20% by weight of ethanol. Thus, the defibrated product contains smaller amounts of fibre dust and an increased amount of long fibres which improve the bulk and the strength of the final fibrous product. Also other solvents than ethanol can be used. However, it is important that the solvent used has a lower heat of evaporation than water so as to permit the evaporation of the solvent together with the water during the defibration and the transportation towards the forming surface and that said solvent is miscible with water.

However, it is normally undesirable to remove all water from the fibres during the treatment in the defibrator. Thus, the defibrated material should preferably contain water in an amount of 5–20% by weight because fibres containing such amount of water are less inclined to form fibre lumps than dry fibres.

The use of solvents also facilitates a uniform distribution of additives into the fibrous sheet material formed. Thus, surface active agents may be added to the dye solution so as to facilitate the penetration of binder, e.g. latex binders, which subsequently are to be introduced.

Also polymerisation catalysts catalysing the polymerisation of a monomer containing binder which is introduced at a later stage may be incorporated in said dye solution. If a latex binder is to be used it may also be desirable to introduce a coagulating agent into the dye solution.

The colour density can be further improved by using a binder and/or fillers of the same colour as the coloured fibres.

The fibre-pulp used in the method according to the invention is preferably cellulose pulp. However, also other types of fibre-pulp for example consisting of leather fibres made from waste leather can be used.

It should be understood that the improved defibration obtained by the addition of a liquid or a mixture of liquids to the fibre-pulp is also obtained in cases when no dye or dye solution is introduced in the fibre-pulp to be defibrated.

The invention will now be described in further detail with reference to the following example.

EXAMPLE

A cellulose pulp web having a thickness of about 2 mm and a moisture content of about 5% was passed through a bath containing a 3% solution of blue anilin dye in 96% ethyl alcohol. Immediately after leaving the bath the web was passed through a set of rollers which was adjusted so as to squeeze away excessive amounts of dye solution. Subsequently, the cellulose pulp containing about 45% solids was introduced into the defibrator. The pulp was defibrated and a suspension of fibres in air was formed. This suspension was caused to pass a gas-permeable forming surface on which the cellulose fibres were deposited so as to form a thin layer containing about 90% solids. The volatile components consisted of about 5% water (the equilibrium moisture content of the cellulose fibres) and 5% ethyl alcohol.

Thus, the major part of the ethyl alcohol added to the pulp sheet was removed during the defibration and the pneumatic transportation of the defibrated product.

We claim:

1. A method of preparing a colored fibrous sheet from an organic fiber pulp, comprising:

a. introducing an organic fiber pulp into a defibrator to form the pulp into individual fibers;

b. introducing into the defibrator an amount of dye material selected from the group consisting of dry dyes and dye solutions, the amount being sufficient to impart a desired color to the individual fibers, wherein the amount of solvent in the dye solution is less than that which would render the formed fibers tacky and cause adherence of the fibers to one another as well as to the walls and moving parts of the defibrator, c. contacting the organic fiber pulp with the dye material to dye all individual fibers, d. suspending the dyed fibers in a formed gaseous stream and passing the stream through a gas-permeable forming surface to form a fibrous layer wherein the dye is uniformly distributed, e. incorporating a binder into the fibrous layer, and f. binding the fibers of the layer into a colored fibrous sheet.

2. A method according to claim 1, wherein the dye material is a solution containing a dye and a solvent therefor.

3. A method according to claim 2, wherein the solvent is water in an amount which is no more than about 30% by weight of the total weight of the fiber pulp to which the dye material is added.

4. A method according to claim 2, wherein the solvent is ethanol in an amount which is no more than about 60% by weight of the total weight of the fiber pulp to which the dye material is added.

5. A method according to claim 1, wherein the dye material is dry dye.

6. A method according to claim 2, wherein the fiber pulp is impregnated with the dye solution prior to introduction into the defibrator.

7. A method according to claim 2, wherein the dye solution is sprayed onto the fiber pulp.

8. A method according to claim 6, wherein the dye solution is applied to the organic fiber pulp by passing a web thereof through a set of rollers in which the surface of one roller is continuously moistened with the dye solution.

9. A method according to claim 1, wherein step (a) and step (b) are performed simultaneously.

10. A method according to claim 1, wherein prior to step (b), the dye material is mixed with a filler.

11. A method according to claim 2, wherein the solvent is a mixture of water and a water-miscible solvent, the watermiscible solvent being capable of being absorbed by the fibers and having a lower heat of vaporization than water.

12. A method according to claim 1, wherein the fiber pulp to be defibrated contains about 20% by weight of ethanol and 20% by weight of water.

13. A method according to claim 2, wherein the dye solution contains another component selected from the group consisting of a surface active agent, a polymerization catalyst, a coagulating agent, and mixtures thereof.

* * * * *